US006309287B2

(12) United States Patent
Martin, III et al.

(10) Patent No.: US 6,309,287 B2
(45) **Date of Patent: *Oct. 30, 2001**

(54) CAM MICRO-FINISHING TOOL

(75) Inventors: Leon Lewis Martin, III, Shelby Township; Peter Michael Lasko, Sterling Heights; James Andrew Rico, Brighton; Fadi Mareen Naddaf, Sterling Heights; John Edward Dumas, Macomb, all of MI (US)

(73) Assignee: Ford Global Technologies, Dearborn, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 49 days.

(21) Appl. No.: 09/232,066

(22) Filed: Jan. 15, 1998

(51) Int. Cl.[7] ..... B24B 21/00
(52) U.S. Cl. ..... 451/303; 451/317
(58) Field of Search ..... 451/28, 49, 301, 451/302, 303, 307, 317

(56) References Cited

U.S. PATENT DOCUMENTS

| | | | | |
|---|---|---|---|---|
| Re. 31,593 | | 6/1984 | Judge, Jr. . | |
| 4,292,767 | * | 10/1981 | Fatula | 51/145 R |
| 4,893,642 | | 1/1990 | Parslow, Jr. et al. . | |
| 4,993,191 | | 2/1991 | Judge et al. . | |
| 5,148,636 | | 9/1992 | Judge et al. . | |
| 5,210,978 | * | 5/1993 | Phillips | 51/141 |
| 5,531,631 | | 7/1996 | Judge . | |
| 5,651,719 | | 7/1997 | Pineau . | |
| 5,695,391 | | 12/1997 | Steinwender . | |
| 5,730,647 | | 3/1998 | Becker et al. . | |
| 5,775,974 | | 7/1998 | Hulsebus . | |
| 5,984,767 | * | 11/1999 | Pineau et al. | 451/302 |
| 6,001,006 | * | 12/1999 | Pineau et al. | 451/297 |

* cited by examiner

*Primary Examiner*—Timothy V. Eley
*Assistant Examiner*—Dung Van Nguyen
(74) *Attorney, Agent, or Firm*—Ford Global Technologies

(57) ABSTRACT

A shoe assembly for a micro-finishing machine for finishing a workpiece includes a C-frame structure adapted for non-rotatable mounting to the micro-finishing machine. The C-frame assembly includes a pair of slats and a replaceable insert secured nonrotatably to the C-frame assembly.

4 Claims, 2 Drawing Sheets

CAM MICRO-FINISHING TOOL

FIELD OF THE INVENTION

The present invention is related to micro-finishing tooling, and more particularly to a replaceable wear surface insert provided on such tooling for finishing cam lobes for internal combustion engine camshafts.

BACKGROUND OF THE INVENTION

U.S. Pat. No. 4,993,191 discloses a tool for micro-finishing cam lobes and is incorporated herein by reference in its entirety. The cam tooling of the '191 patent, typical of prior art finishing tools, includes articulating members to support the film for micro-finishing the cam lobes. As illustrated in FIG. 1 of the '191 patent, rollers 44 are attached to a roller plate 40 by pins 46. The roller plate 40 is held by a support block 36 which is attached to the plates 40 by a pivot pin 42, thereby enabling the roller plates 40 to pivot about the pin 42. The rollers 44 are held by the roller plate 40 with the pins 46 enabling the rollers 44 to rotate. The rollers 44, as shown in FIG. 2 of the '191 patent, support the finishing film 50. These pins and articulating connections are areas which have been discovered to present wear problems with this device. As these connections wear, the precision of the tool is compromised and therefore these worn components must be replaced. Such replacement is both time consuming and expensive, as these wear items are unique to these machines and must be manufactured specifically for this use.

U.S. Pat. No. 5,531,631 illustrates another micro-finishing tool useful for micro-finishing cylindrical workpieces such as crankshaft journals. This tool includes a pair of pivots, as illustrated in FIG. 12 at 94 and 96, about which the micro-finishing shoe 98 rotates. As discussed above, these pivots wear and therefore require replacement of the pins and of the tool hanger 116. This is, again, time consuming and expensive because these are custom parts for this particular machine.

U.S. Pat. No. 5,775,974 discloses a universal jaw attachment for a micro-finishing machine. As shown in FIG. 1, and described in column 2, prior art devices include shoes 32 which are permanently attached to jaw arms 14 and 16. Due to the permanent attachment and unique shape of these shoes, it is expensive and time consuming to service them upon wear, as in the other devices described above. FIGS. 2–4 illustrate a two-piece shoe design utilizing shoe portions 118 permanently attached to jaw arms 121 and 122. Similar to that described above, these shoe portions 118 have a unique shape and are expensive to produce and time consuming to replace. The '974 patent then describes a design to provide a universal shoe, as illustrated in FIGS. 6–10B. As shown in these figures, the universal shoe is complex, requiring several pieces and unique designs, thereby increasing the expense of these parts and the difficulty to service these upon wear. Further, the attachment includes a pinned attachment as best shown in FIGS. 10A and 10B, at 320 and 330. This, again, will produce wear at the pin connections, thereby requiring service of additional parts.

It would therefore be desirable to provide a simple design of a shoe for a camshaft finishing machine, the shoe having improved wear and an inexpensive and easily replaceable wear surface design.

SUMMARY OF THE INVENTION

Accordingly, the present invention provides a shoe assembly for a micro-finishing machine for finishing a workpiece.

The shoe assembly includes a C-frame structure adapted for nonrotatable mounting to the micro-finishing machine and a pair of slats secured nonrotatably to the C-frame assembly. A replaceable insert is nonrotatably secured to the C-frame assembly.

By eliminating the rotatable connections, a machine according to the present invention avoids wear at the rotatable pinned connections. Furthermore, the replaceable insert is inexpensive and is easily replaced.

DETAILED DESCRIPTION OF PREFERRED EMBODIMENTS

Figure 1:
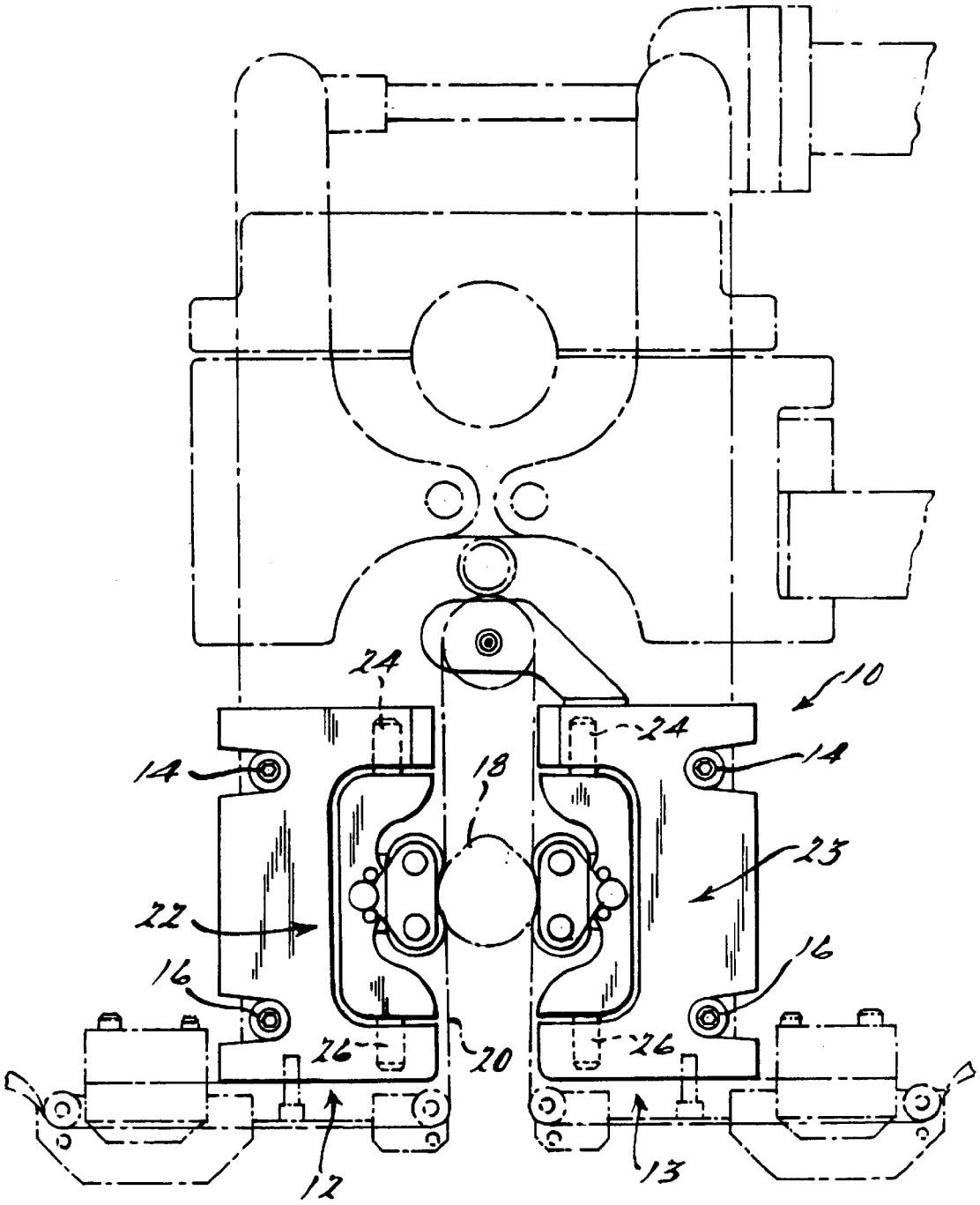
Prior Art FIG. 1.
FIG. 1 is a schematic representation of a prior art micro-finishing machine.

As shown in prior art FIG. 1, a partial view of a micro-finishing machine 10 is shown. The machine 10 includes a pair of shoes 12, 13 attached thereto. The shoes 12, 13 are secured using fasteners 14 and 16. A workpiece 18 is finished between the shoes 12 and 13. The shoes 12 and 13 provide reinforcement for a tape 20 which micro-finishes the surface of the workpiece 18, such as a crankshaft for an internal combustion engine. The shoes 12, 13, as described with reference to first shoe 12, include a pair of support members 22, 23 against which the tape 20 bears. The members 22, 23 have a pinned connection at 24, 26 to the shoes 12, 13. The members 22, 23 thus rotate with respect to the shoes 12, 13 about the pins 24 and 26. As described above with reference to the prior art in the Background section, the shoes 12, 13 wear at these pinned connections 24, 26.

Figure 2:
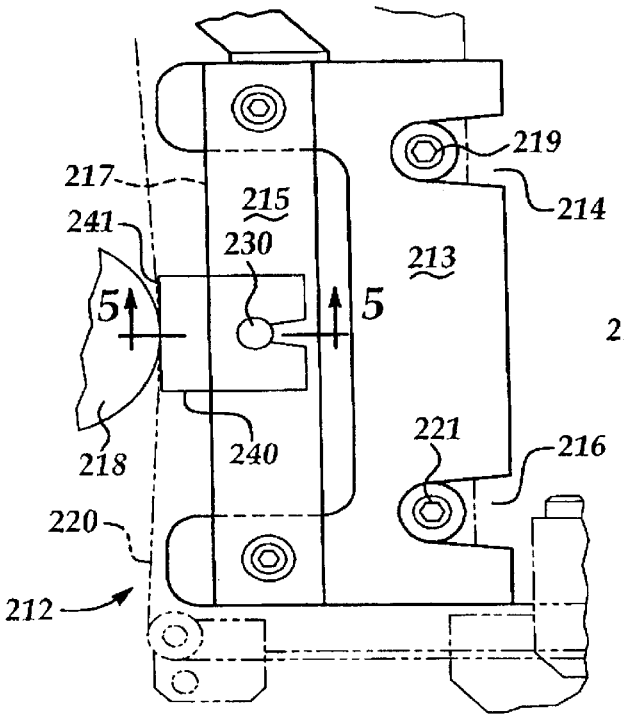
FIG. 2 is a side view of an improved shoe assembly according to the present invention for use in a machine such as the one illustrated in FIG. 1.
Figure 5:
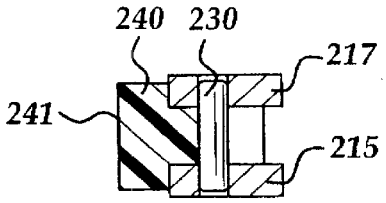
FIG. 5 is a partial sectional side view of the shoe of FIG. 2 taken along the line 5—5.

As shown in FIG. 2, an improved shoe 212 is provided for use in a machine similar to that illustrated in FIG. 1. Shoe 212 may be used by replacing the shoes 12, 13 illustrated in FIG. 1 with improved a pair of shoes 212. The improved shoe 212 includes a C-frame portion 213 having a pair of slats 215, 217 secured thereto using a pair of bolts 219, 221 each in a manner known to one skilled in the art. Alternatively, the slats 215, 217 could be formed or machined integrally, welded, or secured in a manner known to one skilled in the art to the C-frame 213. A pin 230 is press-fit or welded to the slats 215, 217. A replaceable insert 240, shown in FIG. 2 but not illustrated in FIG. 3 for clarity, is press-fit over the pin 230 and secured to the slats 215, 217 by bearing against the slats 215, 217 at the underside of the insert 240 as illustrated in FIG. 5.

Figure 3:
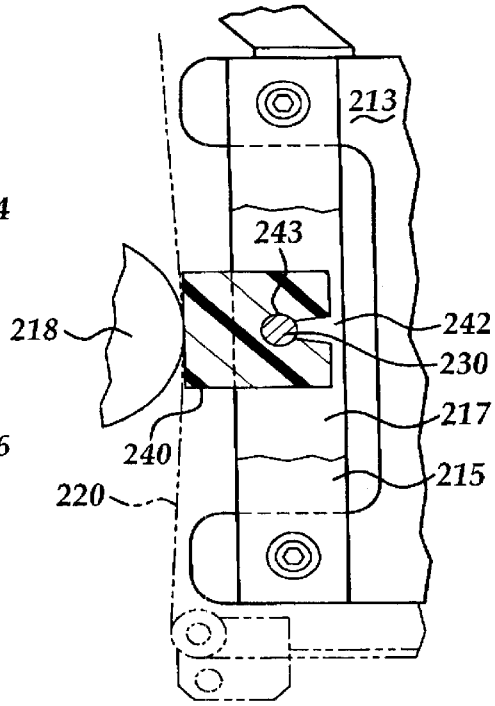
FIG. 3 is a partial side view of the shoe of FIG. 2 with one of the slats broken for viewing of the insert.
Figure 4:
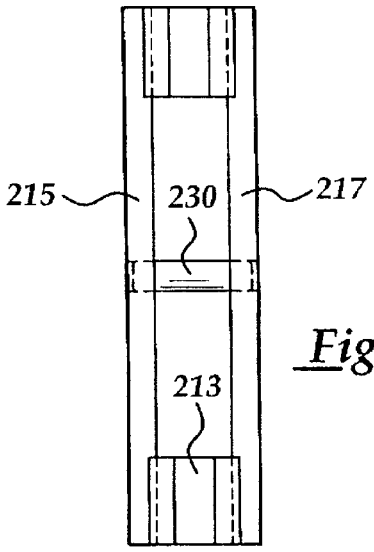
FIG. 4 illustrates a top view of the shoe assembly shown in FIG. 2 with the insert removed.

FIG. 3 illustrates the insert 240 assembled to the pin 230 by breaking away part of the top slat 215. As shown in FIG. 3, insert 240 includes a keyhole-shaped slot 242 providing for a snap-fit to the pin 230. The slot 242 has a tapered first end to position the insert 240 over the pin 230. The keyhole-shaped slot 242 reduces to a width of lesser dimension that the outside diameter of the pin 230 and opens thereafter into a substantially circular portion 243 for engagement with the pin 230. Thus, the insert 240 may simply be installed by pressing onto the pin 230 and removed by pulling or prying the insert 240 away from the pin 230. Thus, the insert 240 may be serviced quickly. This design may be injection molded or machined inexpensively.

The C-frame 213 is secured to the machine 10 using bolts 14, 16 installed through slots 214, 216 in the C-frame 213 in a manner known to one skilled in the art.

Preferably, the insert 240 is made from a glass-filled nylon material, thereby providing an inexpensive, durable wear surface. As shown in FIG. 2, the insert 240 has a substantially planar surface 241 against which the tape 220 bears for machining of the workpiece 218. One skilled in the art appreciates that this planar surface 241 may be modified to be a curvilinear or wedge-shaped surface to accommodate various shapes as dictated by the workpiece 218 to be machined. The material is preferably a sand-filled polyurethane, or any other such material providing adequate wear properties, as known to one skilled in the art. As the material is not a critical part of this invention, further detail is not provided in the present disclosure.

In an alternative embodiment (not illustrated), the pin 230 is not present, and the insert 240 snaps into engagement with the slats 215, 217 in a known manner. In a further alternative embodiment (not shown), the insert 240 is screwed to the slats 215, 217 in a known manner.

While the invention has been shown and described in its preferred embodiments, it will be clear to those skilled in the art to which it pertains, that many changes and modifications may be made thereto without departing from the scope of the invention.

What is claimed is:

1. A shoe assembly for a micro-finishing machine for finishing a workpiece, said shoe assembly comprising:

a C-frame structure adapted for nonrotatable mounting to the micro-finishing machine;

a pair of slats secured nonrotatably to the C-frame structure;

a straight pin fixedly secured to the slats and extending therebetween; and a replaceable snap-fit insert having a tapered key-hole shaped slot which is selectively and nonrotatably secured to the straight pin by pressing the insert onto the straight pin.

2. A shoe assembly according to claim 1, wherein said insert has a planar surface for supporting a finishing film.

3. A shoe assembly according to claim 2 wherein said slates are integrally formed into said C-frame.

4. A method for replacing an insert in a shoe assembly for a micro-finishing machine, comprising:

nonrotatably attaching a C-frame assembly to the microfinishing machine, the C-frame assembly including a pair of nonrotatable slats;

fixedly securing a straight pin between said slats;

providing a replaceable snap-fit insert;

forming a tapered keyhole-shaped slot in said replaceable snap-fit insert;

positioning said slot over said straight pin in said C-frame; and pushing said insert until said slot in said insert snappingly engages said pin, thereby securing said insert onto said straight pin.

* * * * *